US005901420A

United States Patent [19]

Oda

[11] Patent Number: 5,901,420

[45] Date of Patent: May 11, 1999

[54] AUTO-LOCK SLIDE FASTENER SLIDER

[75] Inventor: Kiyoshi Oda, Toyama, Japan

[73] Assignee: YKK Corporation, Tokyo, Japan

[21] Appl. No.: 08/959,846

[22] Filed: Oct. 29, 1997

[30] Foreign Application Priority Data

Oct. 31, 1996 [JP] Japan ..... 8-290568

[51] Int. Cl.[6] ..... A44B 19/30

[52] U.S. Cl. ..... 24/420

[58] Field of Search ..... 24/420, 421, 423, 24/424

[56] References Cited

U.S. PATENT DOCUMENTS

| | | | |
|---|---|---|---|
| 1,607,603 | 11/1926 | Binns et al. | 24/420 |
| 2,068,503 | 1/1937 | Marinsky | 24/420 |
| 2,397,693 | 4/1946 | Rabinow . | |
| 2,554,252 | 5/1951 | Jones | 24/420 |
| 2,689,390 | 9/1954 | Firing | 24/420 |
| 4,041,578 | 8/1977 | Oda . | |
| 4,644,613 | 2/1987 | Kedzierski . | |
| 4,667,376 | 5/1987 | Ishii et al. . | |

FOREIGN PATENT DOCUMENTS

| | | |
|---|---|---|
| 0 451 624 | 10/1991 | European Pat. Off. . |
| 0 612 486 | 8/1994 | European Pat. Off. . |
| 1182545 | 2/1970 | United Kingdom . |

*Primary Examiner*—James R. Brittain
*Attorney, Agent, or Firm*—Hill & Simpson

[57] ABSTRACT

An auto-lock slide fastener slider comprises a slider body, a locking plate and a pull tab. An upper wing of the slider body has a locking-pawl-insertion hole, a recess forwardly extending from the locking-pawl-insertion hole, a locking-plate-attachment projection disposed at the front side of the recess, and a pair of pull-tab-attachment lugs disposed at opposite sides of the recess. The locking plate having at one end an axle rotatably supported by the locking-plate-attachment projection and at the other end a locking pawl inserted in the locking-pawl-insertion hole. The pull tab has at one end a pintle axle rotatably supported by the pull-tab-attachment lugs and a cam on the pintle for pressing the locking plate in such a manner that the locking pawl can project from the locking-pawl-insertion hole to engage a pair of rows of fastener elements. This slider will not give any damage to a garment, thus securing adequate safety.

9 Claims, 6 Drawing Sheets

AUTO-LOCK SLIDE FASTENER SLIDER

BACKGROUND OF THE INVENTION

1. Field of the Invention

This invention relates to an auto-lock slider for use in an ordinary type slide fastener, and more particularly to an auto-lock slide fastener slider in which locking function is performed by pivotal movement of a pull tab, without using a spring.

2. Description of the Related Art

FIG. 7 of the accompanying drawings shows a conventional auto-lock slide fastener slider as disclosed in Japanese Utility Model Publication No. Sho 45-2165. In this conventional slider, a locking leaf spring 102 having a U-shaped locking projection 109 is floatably seated in a central arcuate recess 110 of the upper wing 115 with one end fixed in a recess 133 near a front end of the central recess 110 with the U-shaped locking projection 119 being able to be fitted in the locking-projection-insertion hole 111 provided in a bottom of the recess 110. A pull tab 103 has at one end an axle rotatably supported by a pair of pull-tab-attachment lugs 114 standing on the upper wing 105 at opposite sides of the central recess 110 and a cam 122 on the axle. In response to pivotal movement of the pull tab 103 from an upright posture to a horizontal posture, the cam 122 resiliently bends the leaf spring 102 so as to insert the locking projection 119 through the locking-projection-insertion hole 111 communicating with the recess 110.

FIG. 8 shows another conventional auto-lock slide fastener slider as disclosed in Japanese Utility Model Publication No. Sho 51-523766. In this conventional slider, a locking plate 102 having on its lower surface a locking pawl 119 is loosely received in a recess 110 of the upper wing 105 for pivotal movement about a rear end of the recess 110 and also for sliding movement in longitudinal direction, the cutout having a varying depth progressively increasing from its rear end, which is off the fulcrum 121 of a pull tab 103 to the rear side, toward its front end. The locking plate 102 has on its upper surface a central projection 134 having a perpendicular front surface and a convex rear surface. The pull tab 103 has in its front end portion at a position off an axle 121 a cutaway 120 complementary in shape to the central projection 134 of the locking plate 102 so that the central projection 134 can be fitted in the cutaway 120 when the pull tab 103 assumes a horizontal posture. Also the pull tab 103 has a cam 122 being forward of the cutaway 120 point-symmetric in shape with and contiguous with the central projection 134.

According to the auto-lock slider of FIG. 7, when it assumes a horizontal posture to lock the slider, the pull tab 103 tends to be pushed upwardly partly because the U-shaped locking projection 119 is raised by the fastener elements and partly since the locking leaf spring 102 slides to the rear side by its own restoration, thus resulting in a non-stable locking operation. Further, since the locking projection 119 of the leaf spring 102 is merely curved in a U shape, it tends to deform so that a precise locking operation cannot be expected.

According to the auto-lock slider of FIG. 8, since, in response to pivotal movement of the pull tab 103, the locking plate 102 is pivotally moved in the vertical direction and is slid in the longitudinal direction, it is necessary to press a grip portion of the pull tab against the slider body in order to insert the locking pawl 119 between adjacent fastener elements, thus resulting in a very meticulous and non-smooth locking operation. Further, since, for sliding the slider, it is required to pivotally move and slide the locking plate 102 by pivotally moving the pull tab 103 to an upright posture, a smooth sliding operation cannot be expected as the locking plate 102 is held non-stably.

SUMMARY OF THE INVENTION

A first object of this invention is to provide an auto-lock slide fastener slider in which, though the slider has a locking mechanism performed by a locking pawl, the locking pawl is prevented from giving any hurt or damage to the user or a garment. And moreover, the slider can be operated easily, and a reliable locking function can be performed.

A second object of the invention is to provide an auto-lock slide fastener slider in which a smooth locking operation can be achieved and which is compact in size and neat in appearance.

A third object of the invention is to provide an auto-lock slide fastener slider in which a locking pawl having a specified shape does not give any damage to fastener elements and can secure a simple and effective locking operation.

A fourth object of the invention is to provide an auto-lock slide fastener slider in which, during a locking operation, a pull tab is urged in such a direction as not to be turned, thus securing safety.

A fifth object of the invention is to provide an auto-lock slide fastener slider in which a locking operation can be achieved without difficulty and the locking function can be performed reliably and easily.

A sixth object of the invention is to provide an auto-lock slide fastener slider in which a locking plate having a specified shape so as to swing easily enables the slider to slide smoothly and can perform a reliable locking operation.

A seventh object of the invention is to provide an auto-lock slide fastener slider which is assembled of simple structures and parts, which can be assembled easily and be sturdy, and which can perform a reliable locking operation.

An eighth object of the invention is to provide an auto-lock slide fastener slider which is neat in overall design and which can be simply assembled.

According to a first aspect of the invention, there is provided an auto-lock slide fastener slider comprising: a slider body composed of upper and lower wings joined at their front ends by a guide post to define an element guide channel, the upper wing having a locking-pawl-insertion hole; a locking plate pivotally connected at one end to the upper wing and having at the other end a locking pawl inserted in the locking-pawl-insertion hole in the upper wing for projecting into and retracting from the element guide channel to engage with fastener elements; and a pull tab pivotally connected at one end to the upper wing and having at one end a cam touchable with an upper surface of the locking plate in such a manner that the locking pawl is pressed against a pair of rows of fastener elements.

According to a second aspect of the invention, the upper wing has in its upper surface a recess extending from the center of the upper wing to an upper portion of the element guide post, the recess a part of which communicating with the locking-pawl-insertion hole, for receiving the locking plate, with the locking pawl loosely received in the locking-pawl-insertion hole, the locking pawl having a rounded tip.

According to a third aspect of the invention, the rounded tip of the locking pawl of the locking plate has a shape larger in size than a gap between adjacent fastener elements of a fastener chain in such a manner that the locking pawl may be supported on and between the adjacent fastener elements.

According to a fourth aspect of the invention, when the pull tab is set in a horizontal posture, a point of contact between the cam of the pull tab and the upper surface of the locking plate is disposed off an axis of a pintle of the pull tab toward the pivotally connected end of the locking plate.

According to a fifth aspect of the invention, the lower wing has in its upper surface an element-receiving recess, in which the row of fastener elements can be pushed to be received, confronting the locking pawl disposed on one side of the locking plate.

According to a sixth aspect of the invention, the locking plate has on its upper surface i.e. the surface to contact with the cam a stepped portion so as to escape from touching by the cam of the pull tab.

According to a seventh aspect of the invention, the upper wing has on its upper surface a pair of pull-tab-attachment lugs standing at opposite sides of the recess for attaching the pull tab, and a locking-plate-attachment projection disposed in front i.e. toward the guide post of the recess, the locking plate having at one end an axle rotatably supported by the locking-plate-attachment projection of the recess and the locking pawl at the other end, the pintle of the pull tab having at the center of one end the cam projecting perpendicularly to the pull tab and the pintle extending on both sides of the cam and rotatably supported by the pull-tab-attachment lugs for attachment of the pull tab.

According to an eighth aspect of the invention, the auto-lock slide fastener slider further comprises a cover, the upper wing having on its upper surface a pair of cover-attachment projections for attaching the cover at front and rear sides, respectively, of the recess and a pair of pull-tab-attachment lugs for attaching the pull tab at opposite sides of the recess, the locking plate having at one end a downwardly directed round head and the locking pawl at the other end and being seated in the recess, the pull tab having at one end the pintle, in the center of which the cam projects perpendicularly and which is rotatably supported by the pull-tab-attachment lugs, the cover being put over the pintle axle of the pull tab and having a rectangular box shape and on its inner surface a pair of front and rear engaging projections engageable with the cover-attachment lugs, the cover being fixed onto the cover-attachment projections with the front engaging projection in contact with inside of the cover being engageable with the round head of the locking plate.

DETAILED DESCRIPTION OF THE PREFERRED EMBODIMENTS

Preferred embodiments of an auto-lock slide fastener slider according to this invention will now be described in detail with reference to the accompanying drawings.

Figure 1:
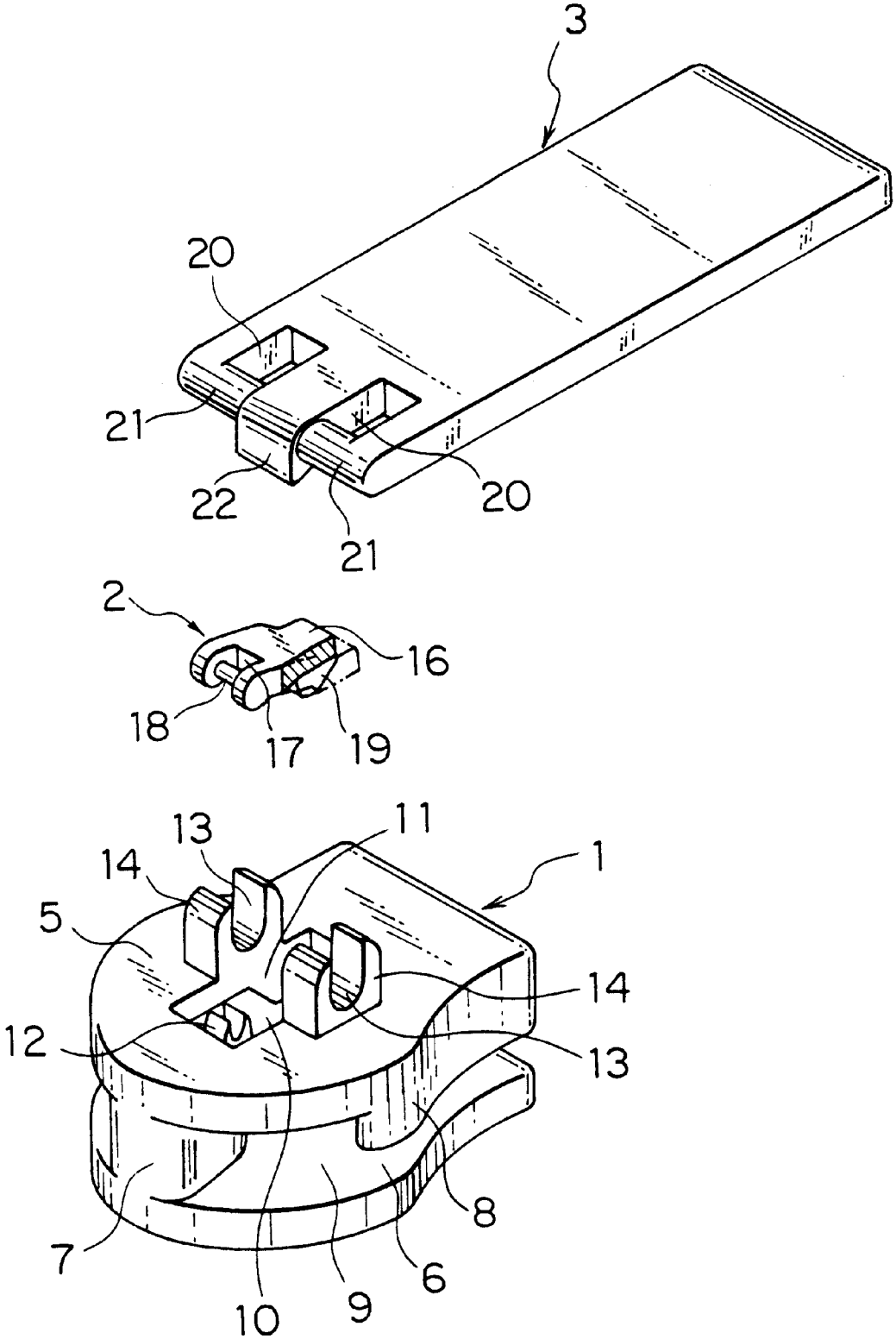
FIG. 1 is an exploded perspective view of an auto-lock slider, for a slide fastener, according to a first embodiment of this invention.
Figure 2:
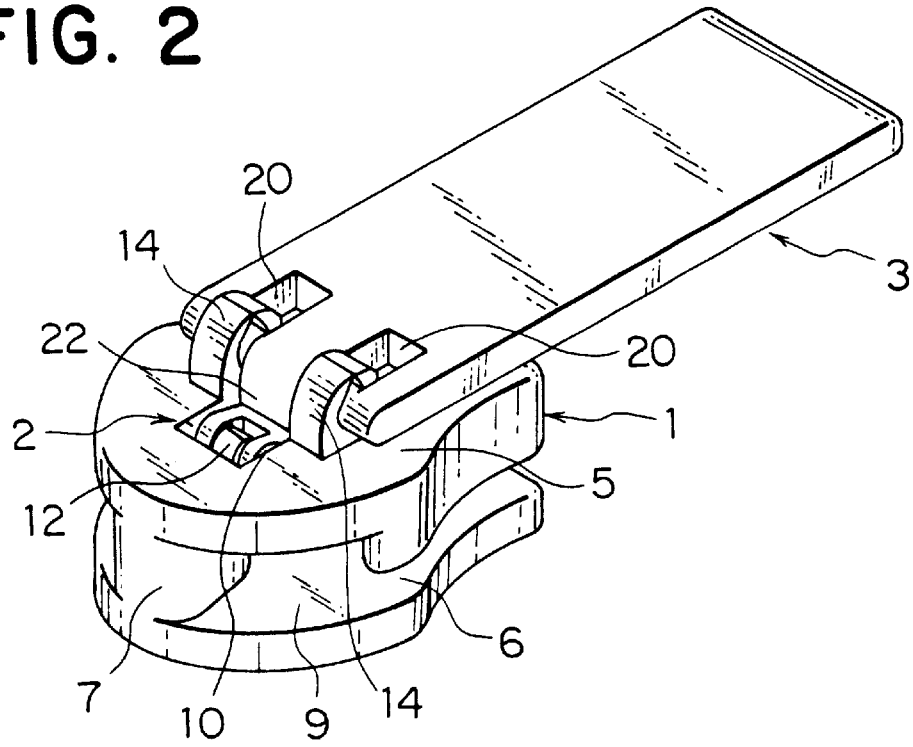
FIG. 2 is a perspective view showing the auto-lock slider as assembled.
Figure 5:
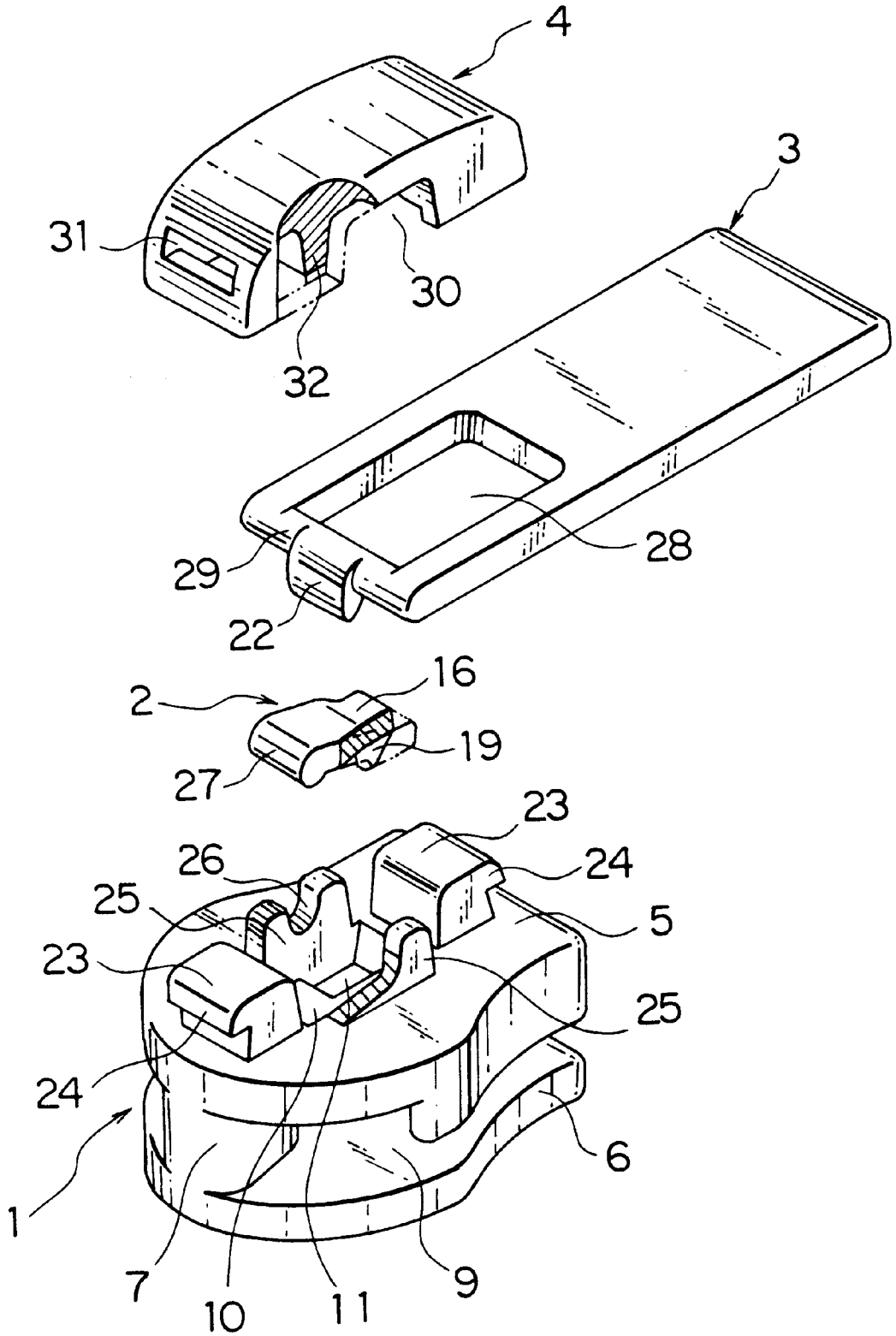
FIG. 5 is an exploded perspective view of a modified auto-lock slider according to a second embodiment of the invention.
Figure 6:
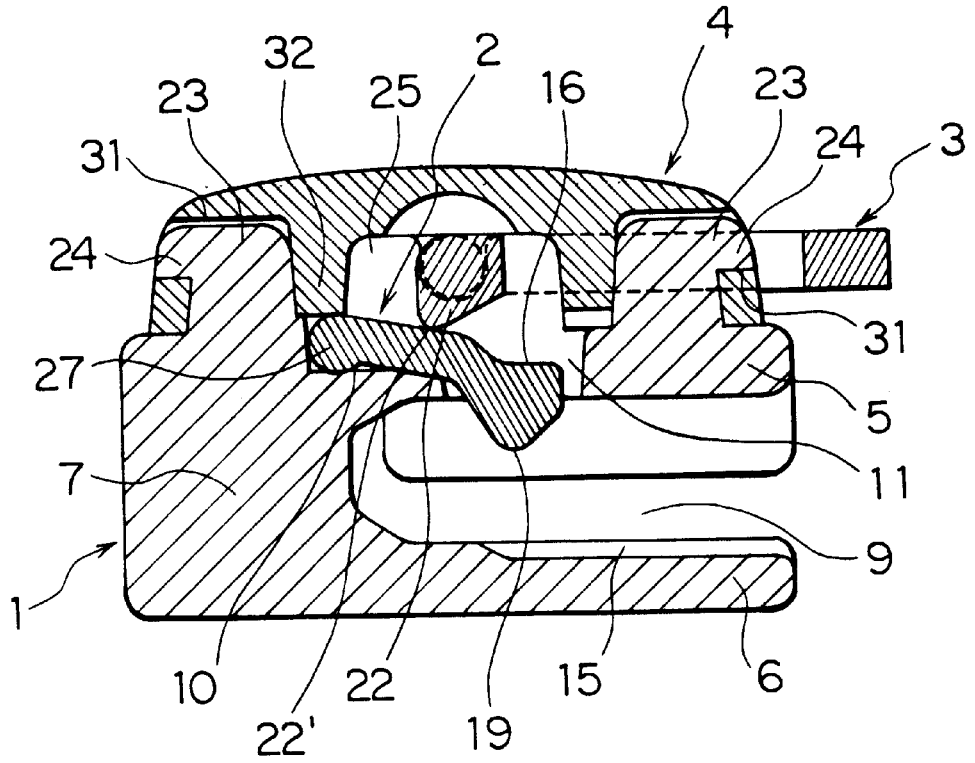
FIG. 6 is a longitudinal cross-sectional view of the modified auto-lock slider in a locked posture in which a locking pawl is pressed against fastener elements.
Figure 7:
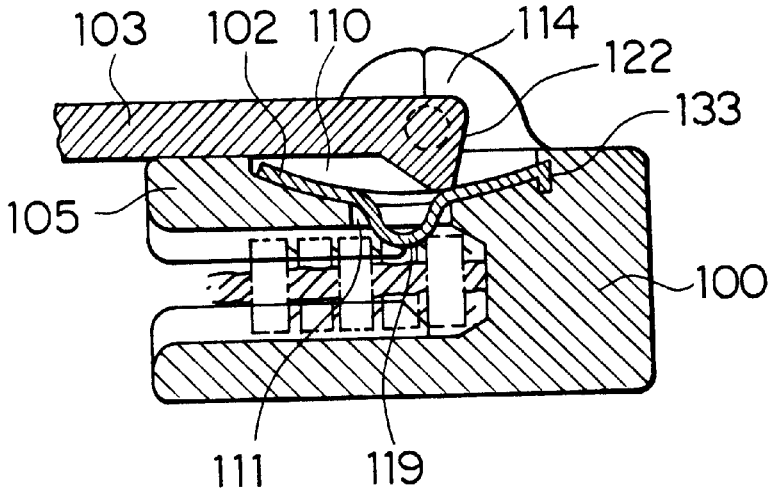
FIG. 7 (PRIOR ART)
FIG. 7 is a vertical cross-sectional view of a conventional auto-lock slider in a locked posture in which a locking projection is pressed against fastener elements.
Figure 8:
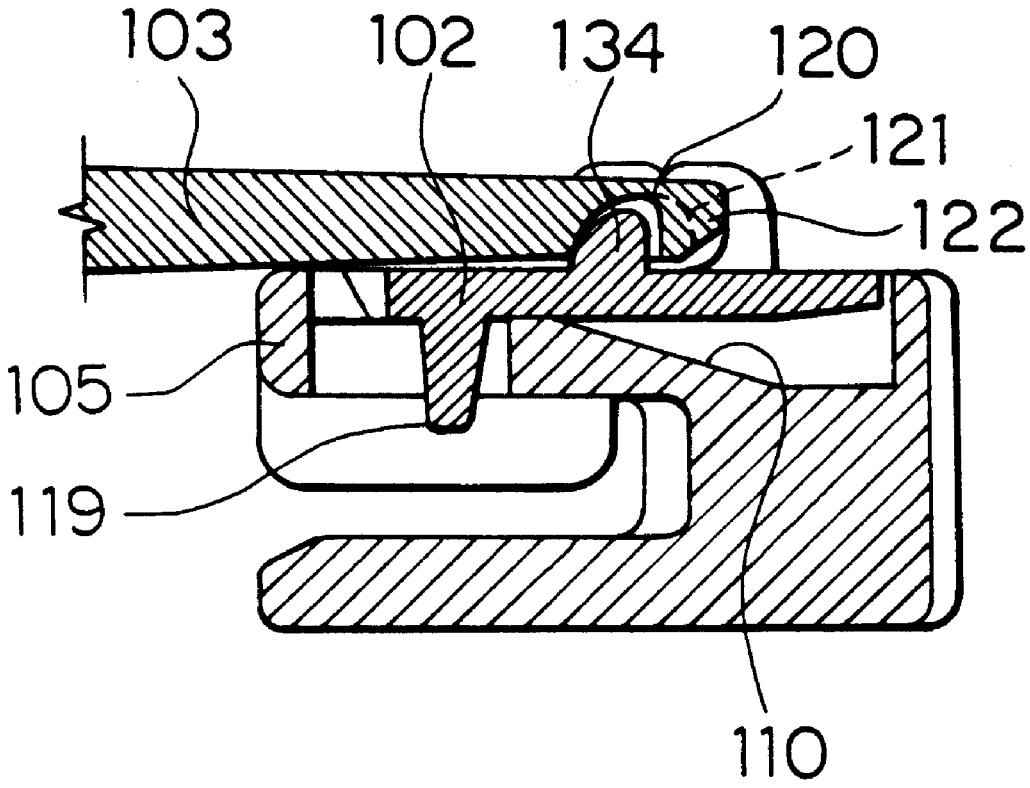
FIG. 8 (PRIOR ART)
FIG. 8 is a longitudinal cross-sectional view of another conventional auto-lock slider in a locked posture in which a locking pawl is pressed against fastener elements.

The auto-lock slide fastener slider of this invention is an ordinary type having a locking mechanism, and is composed of three members, i.e. a slider body 1, a locking plate 2 and a pull tab 3, as shown in FIG. 1 and 2 or four members, i.e. a slider body 1, a locking plate 2, a pull tab 3 and a cover 4, as shown in FIG. 5. These members are molded preferably of metal, such as aluminum alloy or zinc alloy, by die casting, and alternatively they may be molded of thermoplastic resin, such as polyamide, polyacetal or polypropylene, by injection molding. In another alternative form, the slider may be assembled of metal members and thermoplastic members in combination.

In the auto-lock slide fastener slider of FIG. 1, the slider body 1 is composed of upper and lower wings 5, 6 joined by a guide post 7, and the upper wing 5 has along its opposite side edges a pair of flanges 8 to define between the upper and lower wings 5, 6 an element guide channel 9 through which a pair of rows of fastener elements (hereinafter called the fastener elements) are to be guided. The upper wing 5 has in its upper surface a recess 10 extending from the center of an upper surface thereof to an upper portion of the guide post 7, and a locking-pawl-insertion hole 11 extends at a rear position and on one side of the recess 10 to communicate with the element guide channel 9 for accommodating a locking pawl 19 of the locking plate 2. Further, the upper wing 5 has on its upper surface a locking-plate-attachment projection 12 disposed in front of the recess 10 for pivotally attaching the locking plate 2 and a pair of pull-tab-attachment lugs 14 disposed at opposite sides of the recess 10, each pull-tab-attachment lug 14 having a U-shaped cutout 13 for rotatably attaching an axle (described below) of the pull tab 3.

The locking plate 2 has a stepped surface 16 at its upper surface so that the locking plate 2 can escape from contact of a cam (described below) of the pull tab 3 when the pull tab 3 is pulled in order to slide the slider. The locking plate 2 has in one end a cutout 17 and an axle 18 extending across the cutout 17 so that the locking plate 2 is pivotally mounted on the locking-plate-attachment projection 12. And the locking plate 2 has on a lower surface of the other end the round-headed locking pawl 19 disposed off to one side so as to be aligned with the locking-pawl-insertion hole 11, the locking pawl 19 having a round head larger than the gap between adjacent fastener elements so as to be supported between them.

The pull tab 3 is in the form of a rectangular or other plate and has in one end a pair of through-holes 20 on opposite sides and a pintle 21 at ends of the through-holes 20 so that the pull tab 3 is pivotally mounted on the pull-tab-attachment lugs 14. Also the pull tab 3 has a cam 22 extending centrally between the through-holes 20 perpendicularly to the pintle 21 and has a width equal to the width of the locking plate 2. When the pull tab 3 is set to be flat, a peak 22' of the cam 22 is disposed off an axis of the pintle 21 toward the above-mentioned one end and toward the axle side of the locking plate 2 for resting on the upper surface of the locking plate 2.

For assembling, firstly the locking plate 2 is loosely seated in the recess 10 on the upper wing 5 with the axle 18 rotatably supported by the locking-plate-attachment projection 12 and with the locking pawl 19 being inserted in the locking-pawl-insertion hole 11 communicating with the recess 10. Over the locking plate 2, the pintle 21 of the pull tab 3 is received in the U-shaped cutouts 13 of the pull-tab-attachment lugs 14, whereupon the confronting upper ends of each lug 14 are clamped toward each other in such a manner that the axle 21 is rotatably held on the pull-tab-attachment lugs 14 with the cam 22 in contact with the upper surface of the locking plate 2.

Figure 4:
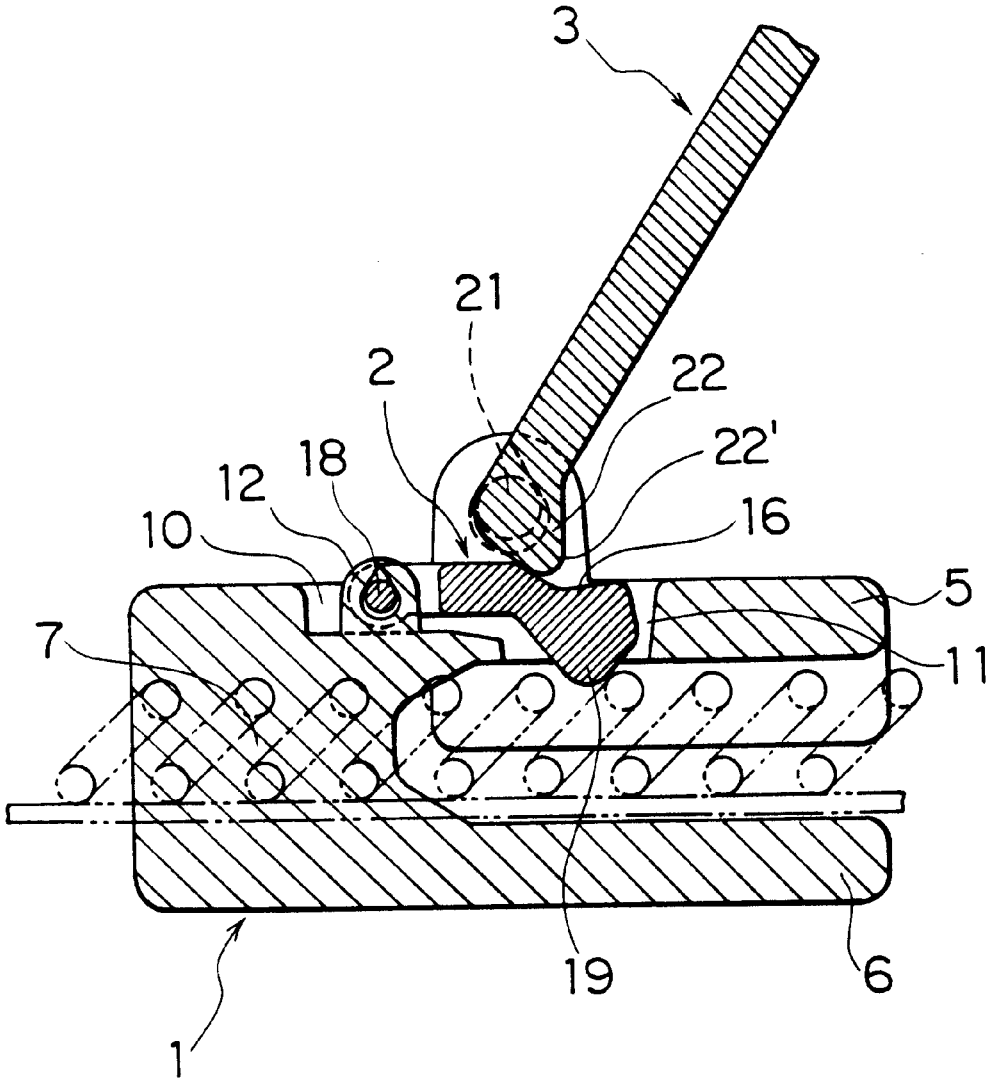
FIG. 4 is a longitudinal cross-sectional view of the auto-lock slider in an unlocked posture in which the locking pawl is released from the fastener elements.

In operation, as shown in FIG. 4, for sliding the slider along the fastener chain, the pull tab 3 is turned to its upright posture to release the cam 22 from pressing the locking plate 2 so that the locking plate 2 can be pivotally moved freely. If the slider body 1 is then slid, the locking plate 2 is floated as the locking pawl 19 is pushed away by the fastener elements. As a result, the slider 1 can be slid freely on the fastener chain as the locking plate 2 is pivotally moved u p and down.

Figure 3:
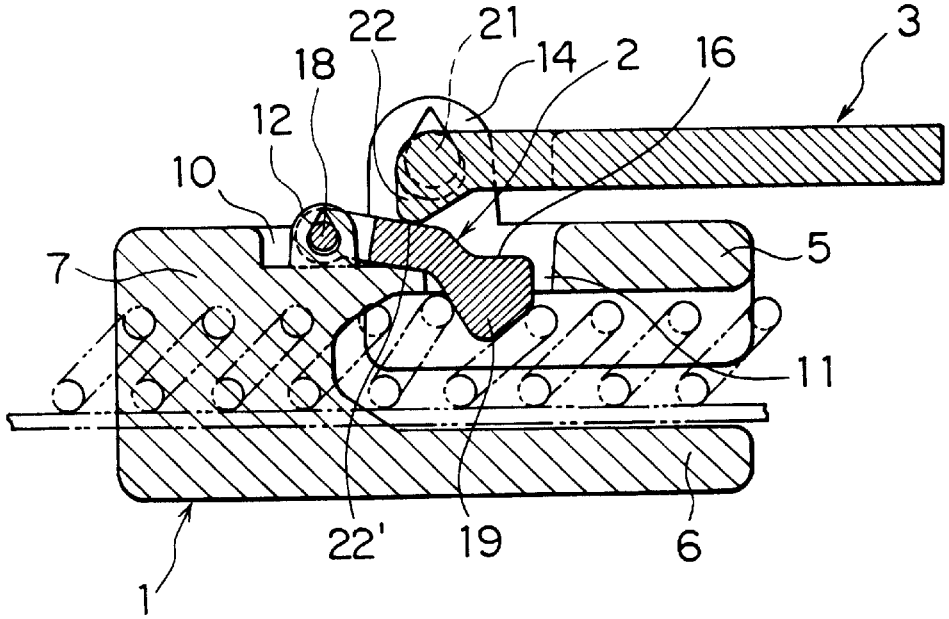
FIG. 3 is a longitudinal cross-sectional view of the auto-lock slider in a locked posture in which a locking pawl is pressed against fastener elements.

For stopping the slider, as shown in FIG. 3, the pull tab 3 is turned to its horizontal posture to press the cam 22 against the upper surface of the locking plate 2 and, at the same time, the peak 22' of the cam 22 touches the upper surface of the locking plate 2 off an axis of the pintle 21 toward the above-mentioned one end of the pull tab 3, thus forcing the locking pawl 19 into the gap between adjacent fastener elements. Thus the slider is kept in locked posture unless the pull tab 3 is turned to its upright posture.

In the auto-lock slide fastener slider of FIG. 5, the slider body 1 is composed of upper and lower wings 5, 6 joined by a guide post 7 so as to define between the upper and lower wings 5, 6 an element guide channel 9. The upper wing 5 has in its upper surface a recess 10 extending from the center of an upper surface thereof to an upper portion of the guide post 7, and a locking-pawl-insertion hole 11 extends at a rear position and on one side of the recess 10 to communicate with the element guide channel 9. Further, the upper wing 5 has on its upper surface a pair of cover-attachment projections 23 at front and rear sides, respectively, of the recess 10 for attaching a cover 4, each cover-attachment projection 23 having a protuberance 24 bulging outwardly from its upper end. Also the upper wing 5 has on its upper surface a pair of pull-tab-attachment lugs 25 at opposite sides of the recess 10, each pull-tab-attachment lug 25 having in its upper end a U-shaped cutout 26 for rotatably receiving a pintle 29 of a pull tab 3. The lower wing 6 also has in its upper surface an element-receiving recess 15 extending from the central position to the rear end.

The locking plate 2 has a stepped surface 16 at its upper surface so that the locking plate 2 can escape from contact of a cam (described below) of the pull tab 3 when the pull tab 3 is pulled in order to slide the slider. The locking plate 2 has at one end a downwardly directed round head 27 through its entire width so that the locking plate 2 is pivotally seated in the first recess 10. And the locking plate 2 has on a lower surface of the other end a round-headed locking pawl 19 disposed off to one side so as to be aligned with the locking-pawl-insertion hole 11, the locking pawl 19 having a round head larger than the gap between adjacent fastener elements so as to be supported between them.

The pull tab 3 has at one end a through-hole 28, the pintle 29 extending cross the through-hole 28 to be supported on the pull-tab-attachment lugs 25, and a cam 22 integrally formed centrally on the pintle 29 and having a width corresponding to a width of the locking plate 2. The cam 22 has a peak 22' disposed off an axis of the pintle 29 to the above-mentioned one end of the pull tab 3.

The cover 4 is in the form of a rectangular box having in opposite side walls a pair of cutaways 30, through which the pintle 29 of the pull tab 3 is to be inserted, and in front and rear walls a pair of rectangular windows 31, in which the respective protuberances 24 of the front and rear cover-attachment projections 23 are to be inserted. Further, the cover 4 has on its inner surface a pair of (front and rear) engaging projections 32 engageable with the front and rear cover-attachment projections 23 on the upper wing 5, respectively, the front engaging projection 32 being also engageable with the round head 27 of the locking plate 2.

For assembling, firstly the locking plate 2 is loosely seated in the recess 10 on the upper wing 5 with the locking pawl 19 is inserted in the locking-pawl-insertion hole 11 communicating with the recess 10. Over the locking plate 2, the pintle 29 of the pull tab 3 is received in the U-shaped cutouts 26 of the pull-tab-attachment lugs 25, whereupon the cover 4 is pressed against the cover-attachment projections 23 in such a manner that the respective protuberances 24 of the front and rear cover-attachment projections 23 are engaged in the front and rear windows 31 of the cover 4 in a snap action with the cam 22 in contact with the upper surface of the locking plate 2, thus fixing the cover 4 to assemble the slider body 1. As an alternative cover-attaching means, opposite side walls of the cover 4 may be clenched against grooves in opposite side surfaces of modified front and rear cover-attachment projections 23 after the cover-attachment projections 23 are covered with the cover 4.

In operation, likewise the previous embodiment, for sliding the slider along the fastener chain, the pull tab 3 is turned to its upright posture to release the cam 22 from pressing the locking plate 2 so that the locking plate 2 can be pivotally moved freely. If the slider body 1 is then slid, the locking plate 2 is floated as the locking pawl 19 is pushed away by the fastener elements. As a result, the slider 1 can be slid freely on the fastener chain as the locking plate 2 is pivotally moved up and down, during which the front engaging projection 32 of the cover 4 is disposed in confronting relation to the round head 27 of the locking plate 2 so that the pivotal movement of the locking plate 2 is restricted within a predetermined range.

For stopping the slider, the pull tab 3 is turned to its horizontal posture to press the cam 22 against the upper surface of the locking plate 2 and, at the same time, the peak 22' of the cam 22 touches the upper surface of the locking plate 2 at a position off the axis of the pintle 21 toward the above-mentioned one end of the pull tab 3, thus preventing the pull tab 3 from pivotally moving to be upright, so that the locking pawl 19 is forced into the gap between adjacent fastener elements to lock the slider. At that time, a pair of rows of fastener elements is forced against the element-receiving recess 15 of the lower wing 6 by the pressing action of the locking pawl 19 to reliably stop the sliding of the slider in the direction of opening the slide fastener. Alternatively, in case of a single fastener element, the fastener element may be forced into the element-receiving recess 15 to prevent slider from sliding.

With the auto-lock slide fastener slider of this invention, the following advantageous results can be achieved:

According to the first aspect of the invention, partly since the locking plate 2 is pivotally mounted at one end on the upper wing 5 and has at the other end the locking pawl 19 for projecting into the element guide channel 9 from the locking-pawl-insertion hole 11 provided in the upper wing 5 and retracting from the element guide channel 9 into the locking-pawl-insertion hole 11, and partly since the pull tab 3 is pivotally connected at one end to the upper wing 5 and has the cam 22 touchable with the upper surface of the locking plate 2 to be floated by the fastener elements, the locking pawl and/or other sharp projection does not expose on the slider surface unlike the conventional slider, in which a locking pawl is formed directly on the pull tab, thus giving no hurt to the user or no damage to a garment. Further, this slider is safe and excellent in operability and secures a reliable locking operation.

According to the second aspect of the invention, partly since the upper wing has a recess extending from its center to the upper portion of the guide post 7 and the locking-pawl-insertion hole 11 communicating with the recess 10, and partly since the locking plate 2 is seated in the recess with the round-headed locking pawl 19 loosely inserted in the locking-pawl-insertion hole 11, the entire locking plate 2 is accommodated within the slider body 1, thus making the slider neat in appearance without increasing the height of the slider body. Further, since the locking pawl 19 has a round head, smooth sliding of the slider can be achieved.

According to the third aspect of the invention, since the round-headed locking pawl 19 of the locking plate 2 is larger than the gap between adjacent fastener elements and can be supported between the adjacent fastener elements, it is possible to move the locking plate 2 without damaging the fastener elements, unlike the conventional slider in which a round-headed locking projection is to be inserted between adjacent fastener elements, thus realizing a smooth locking operation.

According to the fourth aspect of the invention, since, when the pull tab 3 is in upright posture, the point of contact between the cam 22 of the pull tab 3 and locking plate 2 is disposed off the pintle 21 of the pull tab 3 toward the pivot end of the locking plate 2, the pull tab is prevented from being pivotally moved when it is in horizontal posture, thus making the slider neat in appearance.

According to the fifth aspect of the invention, since the lower wing 6 has in its upper surface the element-receiving recess 15 facing the locking-pawl-insertion hole 11 of the upper wing 5 so as to confront with the locking pawl 19 of the locking plate 2, the fastener elements can be forced into the element-receiving recess 15 by the locking pawl 19 when the pull tab 3 is turned to its horizontal posture, thus the slider is prevented from sliding. Especially the slider is completely prevented from moving in an opening direction, thus it is suitable for the fastener chain having a single element, achieving a reliable locking operation.

According to the sixth aspect of the invention, since the locking plate 2 has on its upper surface a stepped surface 16 so as to escape from contact with the cam 22, the locking plate 2 can be floated by the fastener elements so as to pivotally move freely, thus realizing smooth sliding of the slider.

According to the seventh aspect of the invention, partly since the upper wing 5 has the pair of pull-tab-attachment lugs 14 standing on said upper surface at opposite sides of the recess 10 for rotatably supporting the axle 18 of the locking plate 2, and partly since the upper wing 5 has the locking-plate-attachment projection 12 disposed in front of the recess 10 for rotatably supporting the axle of the pull tab, partly since the locking plate 2 has the axle 18 at one end and the locking pawl 19 at the other end, partly since the pull tab 3 has at the center of one end the cam 22 having the pintle 21 extending on both sides of the cam 22, partly since the axle 18 of the locking plate 2 is pivotally attached to the locking-plate-attachment projection 12, and partly since the pintle 21 of the pull tab 3 is pivotally attached to the pull-tab-attachment lugs 14, the auto-lock slider composed of three members of the slider body 1, the locking plate 2, and the pull tab 3 can be assembled simple in structure with simple members, the slide being suitable for automatic assembling, thus improving the rate of production.

According to the eighth aspect of the invention, partly since the upper wing 5 has on its upper surface the pair of cover-attachment projections 23 at front and rear sides, and the pair of pull-tab-attachment lugs 25 at opposite sides, respectively of the recess 10 for rotatably supporting the pintle 29 of the pull tab 3, partly since the locking plate 2 has at one end the downwardly directed round head 27 and at the other end the locking pawl 19, partly since the pull tab 3 has at one end the pintle 29 having in its center a cam 22, partly since the cover 4 has in its inner surface the engaging projections 32 which are engageable with the cover-attachment projections 23, and partly since the locking plate 2 is loosely seated in the recess 10 and the pintle 29 of the pull tab 3 is mounted on the pull-tab-attachment lugs 25, and then the cover 4 is put on from the above, so that the cover 4 is fixed to the cover-attachment projections 23 while the engaging projections 32 are engageable with the round head 27, the auto-lock slider composed of four members i.e. the slider body 1, the locking plate 2, the pull tab 3 and the cover 4 can be assembled simple in structure with simple members, thus the slider can be neat in appearance and the slider can be automatically assembled at higher speed to improve productivity.

What is claimed is:

1. An auto-lock slide fastener slider for use with fastener elements comprising:

(a) a slider body composed of upper and lower wings joined at their front ends by a guide post to define an element guide channel, said upper wing having a locking-pawl-insertion hole;

(b) a locking plate freely pivotally connected at one end to said upper wing and having at the other end a locking pawl inserted in said locking-pawl-insertion hole in said upper wing for projecting into and retracting from said element guide channel; and (c) a pull tab freely pivotally connected at one end to said upper wing and having a cam touchable with an upper surface of said locking plate in such a manner that said locking pawl is pressed against longitudinally adjacent fastener elements, wherein when said pull tab is set in a horizontal posture, a point of contact between said cam of said pull tab and said locking plate is disposed off an axis of a pintle of said pull tab toward the pivotally connected end of said locking plate.

2. An auto-lock slide fastener slider according to claim 1, wherein said upper wing has in its upper surface a recess extending from the center of said upper wing to an upper portion of said element guide post, said recess communicating with said locking-pawl-insertion hole, for receiving said locking plate, with said locking pawl loosely received in said locking-pawl-insertion hole, said locking pawl having a rounded tip.

3. An auto-lock slide fastener slider according to claim 2, wherein said rounded tip of said locking pawl of said locking plate may be supported on and between the adjacent fastener elements.

4. An auto-lock slide fastener slider according to claim 2, wherein when said pull tab is set in a horizontal posture, a point of contact between said cam of said pull tab and said locking plate is disposed off an axis of a pintle of said pull tab toward the pivotally connected end of said locking plate.

5. An auto-lockslide fastener slider according to claim 2 or 4, wherein said upper wing has on its upper surface a pair of pull-tab-attachment lugs standing at opposite sides of said recess, and a locking-plate-attachment projection disposed in front of said recess, said locking plate being seated in said recess and having at one end an axle rotatably supported by said locking-plate-attachment projection and said locking pawl at the other end, said pintle of said pull tab having at the center of one end said cam projecting perpendicularly to said pull tab, and said pintle extending on both sides of said cam and rotatably supported by said pull-tab-attachment lugs.

6. An auto-lock slide fastener slider according to claim 2 or 4, further comprising a cover, said upper wing having on its upper surface a pair of cover-attachment projections at front and rear sides, respectively, of said recess and a pair of pull-tab-attachment lugs at opposite sides of said recess, said locking plate having at one end a downwardly directed round head and at the other end said locking pawl and being seated in said recess, said pull tab having at one end said pintle, in the center of which said cam projects perpendicularly and which is rotatably supported by said pull-tab-attachment lugs, said cover being put over said pintle of said pull tab and having on its inner surface a pair of front and rear engaging projections engageable with said cover-attachment lugs, said cover being fixed onto said cover-attachment projections with said front engaging projection being engageable with said round head of said locking plate.

7. An auto-lock slide fastener slider according to claim 1, wherein said lower wing has in its upper surface an element-receiving recess confronting said locking pawl disposed on one side of said locking plate.

8. An auto-lock slide fastener slider according to claim 1, wherein said locking plate has on its upper surface a stepped portion so as to escape from touching by said cam of said pull tab.

9. An auto-lock slide fastener slider according to claim 1, wherein the locking plate and the pull tab are freely pivotally connected to the upper wing at different locations on the upper wing.

* * * * *